US005196035A

United States Patent [19]

Johnson

[11] Patent Number: 5,196,035

[45] Date of Patent: Mar. 23, 1993

[54] GASOLINE COMPOSITION FOR REDUCING INTAKE VALVE DEPOSITS IN PORT FUEL INJECTED ENGINES

[75] Inventor: Thomas H. Johnson, Houston, Tex.

[73] Assignee: Shell Oil Company, Houston, Tex.

[21] Appl. No.: 763,010

[22] Filed: Sep. 20, 1991

[51] Int. Cl.[5] ..... C10L 1/22; C10L 1/18

[52] U.S. Cl. ..... 44/350; 44/432; 44/433; 564/453; 564/455

[58] Field of Search ..... 44/432, 433, 350; 564/453, 455, 458, 459, 460, 461

[56] References Cited

U.S. PATENT DOCUMENTS 3,884,647 5/1975 Nakaguchi ..... 44/433
4,353,711 10/1982 Childs ..... 44/433
4,392,866 7/1983 Sung et al. ..... 44/433
5,006,130 4/1991 Aiello et al. ..... 44/432

*Primary Examiner*—Ellen Mc Avoy

[57] ABSTRACT

The present invention is directed to compositions prepared by reacting (a) an oil soluble polyalkylene polyamine containing at least one polyalkylene polymer chain having at least one double bond and which chain is attached to a nitrogen and/or carbon atom of the alkylene radical(s) connecting the amino nitrogen atoms with said alkaline polyamine having a molecular weight of the range of from about 600 to about 10,000 and (b) furan under Diels-Alder reaction conditions. The invention also relates to the use of the subject compositions as additives in an unleaded fuel gasoline compositions to reduce intake valve deposits in electronic port fuel injected engines.

20 Claims, No Drawings

GASOLINE COMPOSITION FOR REDUCING INTAKE VALVE DEPOSITS IN PORT FUEL INJECTED ENGINES

BACKGROUND OF THE INVENTION

1. Field of the Invention

The present invention relates to compositions suitable for use in gasoline mixtures for reducing intake valve deposits in port fuel injected engines.

2. Background

Gasoline compositions have traditionally been formulated to improve the performance of carburetor and throttle body injected engines. Beginning in about 1984, electronic port fuel injected engines were commonly introduced by automobile manufacturers. Shortly thereafter, in about 1985, problems began to be reported with intake valve deposits in electronic port fuel injected engines characterized by hard starting, stalls, and stumbles during acceleration and rough engine idle.

Accordingly, it would be desirable to have fuel compositions which reduced or eliminated such undesirable intake valve deposits in electronic port fuel injected engines. Also, since some carburetor and throttle body injector engines will still be in use for the foreseeable future, it would be desirable if such fuels could also be compatible with these engines.

OBJECT OF THE INVENTION

It is an object of this invention to provide a gasoline composition which reduces intake valve deposits in electronic port fuel injected engines and the poor driveability which is characteristic of intake valve deposition in these engines and which is also compatible with carburetor and throttle body injected engines which are still in use.

SUMMARY OF THE INVENTION

The present invention is directed to compositions comprising the reaction product of (a) an oil soluble polyalkylene polyamine containing at least one polyalkylene polymer chain having at least one double bond and which chain is attached to a nitrogen and/or carbon atom of the alkylene radical(s) connecting the amino nitrogen atoms with said alkaline polyamine having a molecular weight in the range of from about 600 to about 10,000 and (b) furan, said reaction product being obtained under Diels-Alder reaction conditions. The invention also relates to the use of the subject compositions in an unleaded fuel gasoline composition comprising a major amount of a hydrocarbon base fuel of the gasoline boiling range containing an effective amount of said composition, generally in the range of from about 25 to about 1000 ppmw based on the fuel composition, to reduce intake valve deposits in electronic port fuel injected engines.

DESCRIPTION OF THE PREFERRED EMBODIMENTS

Alkylene Polyamine Reaction Component

The oil soluble polyalkylene polyamine reaction component (a) has at least one polymer chain having a molecular weight in the range from about 500 to about 9,900 and preferably from about 550 to about 4,900, and particularly from 600 to 1,300, and which may be straight or branched chain and which contains at least one olefinic double bond and is attached to a nitrogen and/or carbon atom of the alkylene radical(s) connecting the amino-nitrogen atoms.

Preferred polyalkylene polyamines have the structural formula I

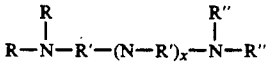

$$R-\overset{\overset{\displaystyle R}{|}}{N}-R'-(N-R')_x-\overset{\overset{\displaystyle R''}{|}}{N}-R'' \qquad (I)$$

where R is selected from the group consisting of a hydrogen atom and a polyolefin containing at least one olefinic double bond and having a molecular weight from about 500 to about 9,900, at least one R being a polyolefin group, R' is an alkylene radical having from 1 to 8 carbon atoms, preferably 1 to 4 carbon atoms, R'' is hydrogen or lower alkyl, and "x" is 0–5. Preferred is when one R is a branched-chain olefin polymer and the other R is hydrogen. The molecular weight range of R is preferably 550 to 4,900, with a molecular weight range of 600–1300 being particularly preferred.

The olefinic polymers (R) which are reacted with polyamines to form the polyalkylene polyamine reaction component (a) include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-poly-alpha-methyl styrene groups. Particularly preferred are polypropylene and especially polyisobutylene groups.

The polyolefin polymer group R contains at least one olefinic double bond. When such groups are prepared by polymerization of olefins, the resulting products will frequently have at least one double bond as a result of the polymerization process. Alternatively, double bonds can be added to saturated polyalkylene polymers by any of a number of tradition means, such as by chlorination followed by dehydrochlorination.

The R'' group may be hydrogen but is preferably lower alkyl, i.e., containing up to 7 carbon atoms, and more preferably is selected from methyl, ethyl, propyl and butyl groups.

The polyamines used to form the aliphatic polyamine compounds of this invention include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to about 18 carbon atoms. In the preparation of these compounds the same amines can be used or substituted amines can be used such as N-methyl ethylene diamine, N-propyl ethylene diamine, N,N-dimethyl 1,3-propane diamine, N-2-hydroxypropyl ethylene diamine, penta-(1-methylpropylene)hexamine, tetrabutylene-pentamine, hexa-(1,1-dimethylethylene)heptane, di-(1-methylamylene)-triamine, tetra-(1,3-dimethylpropylene)pentamine, penta-(1,5-dimethylamylene)-hexamine, di(1-methyl-4-ethylbutylene)triamine, penta-(1,2-dimethyl-1-isopropyl ethylene)-hexamine, tetraoctylenepentamine and the like.

Compounds possessing triamine as well as tetramine and pentamine groups are applicable for use because these can be prepared from technical mixtures of polyethylene polyamines, which could offer economic advantages.

The polyamine can be a cyclic polyamine, for instance, the cyclic polyamines formed when aliphatic polyamines with nitrogen atoms separated by ethylene groups were heated in the presence of hydrogen chloride.

An example of a suitable process for the preparation of the polyalkylene polyamine reaction component is the reaction of a halogenated polyhydrocarbon having at least one halogen atom as a substituent and a hydrocarbon chain as defined hereinbefore for R with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least about 160° C.

The reaction between polyhydrocarbon halide and a polyamine having more than one nitrogen atom available for this reaction is preferably effected in such a way that cross-linking is reduced to a minimum, for instance, by applying an excess of polyamine.

The molecular weight of the polyamine will range from about 600 to about 10,000, preferably from about 600 to about 5000, and most preferably from about 600 to about 1500.

Alkylene Polyamine/Furan Reaction

The compositions of the instant invention are prepared by reacting the polyalkylene polyamines described above with furan ($C_4H_4O$) under Diels-Alder reaction conditions. The Diels-Alder reaction describes the 1,4-addition of an alkene to a conjugated diene. It is a thermal reaction that has been carried out at a wide range of conditions, depending on the reactants. Temperatures range from room temperature, or slightly less to up to about 200° C., e.g., from about 0° C., preferably from about 20° C. to about 50° C. Pressures are not critical and can range from atmospheric to 100 bar or higher.

At least about one mole of furan is reacted with one mole of polyalkylene polyamine. However, since the Diels-Alder reaction between the polyalkylene polyamine and the furan results in another double bond being regenerated in the polyalkylene moiety after reaction, more than one furan group can be added to the polyalkylene polyamine by the instant process. This will be accomplished by increasing the mole ratio of furan to polyalkylene polyamine in the reaction mixture, say to up to 3:1 or 5:1 or even up to 10:1.

Gasoline Compositions

The total amounts of the instant compositions incorporated into fuel compositions will range from about 25 to about 1000 preferably from about 50 to about 500 and most preferably from about 100 to about 400 parts per million by weight (ppmw) based on the fuel composition.

Suitable liquid hydrocarbon fuels of the gasoline boiling range are mixtures of hydrocarbons having a boiling range of from about 25° C. (77° F.) to about 232° C. (450° F.) and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer or trimerized olefins, synthetically produced aromatic hydrocarbon mixtures from thermally or catalytically reformed hydrocarbons, or from catalytically cracked or thermally cracked petroleum stocks, and the like or mixtures of these. The hydrocarbon composition and octane level of the base fuel are not critical. The octane level, $(R+M)/2$, will generally be above 85. Any conventional motor fuel base may be employed in the practice of this invention. For example, in the gasoline, hydrocarbons can be replaced by up to substantial amounts of conventional alcohols, or ethers, conventionally known for use in fuels. The base fuels are desirably substantially free of water, since water could impede a smooth combustion.

Normally, the hydrocarbon fuel mixtures to which the invention is applied are essentially lead-free, but can contain minor amounts of blending agents such as methanol, ethanol, methyl tertiary butyl ether, and the like, e.g., at from about 0.1 to about 15% volume of the base fuel. The fuels can also contain antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins and the like. Corrosion inhibitors, such as a polyhydric alcohol ester of a succinic acid derivative having on at least one of its alpha-carbon atoms an unsubstituted or substituted aliphatic hydrocarbon group having 20 to 500 carbon atoms, for example, pentaerythritol diester of polyisobutylene-substituted succinic acid, the polyisbutylene group having an average molecular weight of about 950, in an amount of about 1 to 1000 ppmw. The fuels may also contain antiknock compounds such as a methyl cyclopentadienylmanganese tricarbonyl, orthoazidophenol and the like as well as co-antiknock compounds such as benzoylacetone.

The additive compositions of the present invention can be added to the fuel neat or in the form of a concentrate. For example, the agent can be added separately to the fuel or blended with the other fuel additives. A concentrate can be prepared comprising a major amount of the additive mixture of the invention and a minor amount of a fuel compatible diluent boiling in the range of about 50° C. to 232° C. The additive can be added to the fuel at any point prior to its delivery to the end user.

The invention also provides a method for operating a port fuel injected engine on an unleaded fuel compatible with carburetor and throttle body injected engines which comprises introducing into an electronic port fuel injected engine with the combustion intake charge an effective amount to reduce intake valve deposits of a compositions comprising the reaction product of (a) an oil soluble polyalkylene polyamine containing at least one polyalkylene polymer chain having at least one double bond and which chain is attached to a nitrogen and/or carbon atom of the alkylene radical(s) connecting the amino nitrogen atoms with said alkaline polyamine having a molecular weight in the range of from about 600 to about 10,000 and (b) furan, said reaction product being obtained under Diels-Alder reaction conditions.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

ILLUSTRATIVE EMBODIMENT

Composition Preparation

The polyalkylene polyamine used in the following examples was prepared by reacting polyisobutylene chloride with N,N-dimethyl 1,3-propanediamine (dimethylaminopropylamine or "DAP") to produce polyisobutylene diaminopropane referred to herein as "PIB-DAP" having a molecular weight of about 1000–1200 as measured by vapor phase osmometry ("VPO"). It was used in a xylene carrier (19.5% wt xylene).

EXAMPLE 1

166.7 Grams (0.19 moles) of the above-described PIB-DAP (molecular weight/standard deviation = 1162/22) and 51.7 grams (0.76 moles) were placed in a 300 ml autoclave at room temperature and 600 psig nitrogen pressure. The reaction was stirred under pressure for about 24 hours. The pressure had gradually dropped to about 450 psig at the end of the 24 hours. The contents of the autoclave were transferred to a Rotovap and the volatiles were evaporated off. Analysis of the resulting PIB-DAP-FURAN by ASTM D2503 showed a molecular weight/standard deviation of 1144/46 for 13 different preparations. Further analysis of this product was performed by effecting a retro Diels-Alder reaction by exposing the product to temperatures of about 250° C. and analyzing the resultant gases by GC/MS. This confirmed that furan had been cleaved from the PIB-DAP-FURAN material.

EXAMPLE 2

500 Grams (0.60 moles) of the above-described PIB-DAP (molecular weight = 1002) were place in a 3-neck, 1000 ml round bottom flask, equipped with an air stirrer, reflux condenser, and addition funnel. 163 Grams of furan (2.4 moles) were added to the PIB-DAP/xylene mixture at room temperature with constant stirring. Once addition was completed, heat was introduced and the solution was refluxed for about 48 hours. After refluxing the solution was transferred to a 1000 ml Rotovap flask and the volatiles were evaporated off. Analysis of the resulting PIB-DAP-FURAN by ASTM 2503 showed a molecular weight of 1102 by VPO. Further analysis, as described above, revealed furan could be removed by retro Diels-Alder thermal conditions.

Engine Tests

Fuels with and without the additive of the instant invention were tested in a Ford 3.0 liter engine with Port Fuel Injection (PFI) for 100 hours to determine the effectiveness of the instant additives in reducing intake valve deposits.

The base fuel comprised premium unleaded gasoline. The polyisobutylene-diaminopropane-furan compound prepared as noted in Example 1 was used as the intake valve reducing additive.

Each engine was in clean condition at the start of the test, i.e., oil and filters were changed and all deposits had been removed from the intake manifolds, intake ports and combustion areas of the engine. In order to test for the accumulation of deposits in the engine during each test, the engines were operated on a cycle consisting of idle mode and cruising modes of 30, 35, 45, 55 and 65 miles an hour with accelerations and decelerations. The tests were conducted for 100 hours and the weight of the intake value deposits was measured. Results of these tests are set forth in Table 1 below.

TABLE 1

Intake Valve Deposits for PIB-DAP-FURAN Additive

| Additive | Average Deposit Weight, mg |
|---|---|
| None | 173 |
| PIB-DAP-FURAN | 9 |

Results of these tests demonstrate that the composition of the invention is very useful in very significantly preventing the accumulation of deposits in the engines tested as compared to the effects of the base fuel as shown by the much lower average valve deposits.

What is claimed is:

1. A composition comprising the reaction product of (a) an oil soluble polyalkylene polyamine containing at least one polyalkylene polymer chain having at least one double bond and which chain is attached to a nitrogen and/or carbon atom of the alkylene radical(s) connecting the amino nitrogen atoms and said polyalkylene polyamine having a molecular weight in the range of from about 600 to about 10,000 and (b) furan, wherein the mole ratio of furan to polyalkylene polyamine ranges from about 1:1 to about 10:1, said reaction product being obtained under Diels-Alder reaction conditions wherein the temperature ranges from about 0° C. to about 200° C.

2. The composition of claim 1 wherein the polyamine has a molecular weight in the range of from about 600 to about 5000.

3. The composition of claim 2 wherein the polyamine has a molecular weight in the range of from about 600 to about 1500.

4. The composition of claim 1 wherein the reaction conditions comprise a temperature ranging from about 20° C. to about 50° C.

5. The composition of claim 1 wherein the polyalkylene polyamine is polyisobutylene-N,N-dimethyl 1,3-propanediamine.

6. The composition of claim 1 wherein the mole ratio of furan to polyalkylene polyamine ranges from about 1:1 to about 3:1.

7. An unleaded fuel composition comprising a major amount of a hydrocarbon base fuel of the gasoline boiling range containing an effective amount to reduce intake valve deposits in electronic port fuel injected engines of from about 25 ppmw to about 1000 ppmw based on the fuel composition of a composition comprising the reaction product of (a) an oil soluble polyalkylene polyamine containing at least one polyalkylene polymer chain having at least one double bond and which chain is attached to a nitrogen and/or carbon atom of the alkylene radical(s) connecting the amino nitrogen atoms with said polyalkylene polyamine having a molecular weight in the range of from about 600 to about 10,000 and (b) furan, wherein the mole ratio of furan to polyalkylene polyamine ranges from about 1:1 to about 10:1, said reaction product being obtained under Diels-Alder reaction conditions wherein the temperature ranges from about 0° C. to about 200° C.

8. The composition of claim 7 wherein the polyamine has a molecular weight in the range of from about 600 to about 5000.

9. The composition of claim 8 wherein the polyamine has a molecular weight in the range of from about 600 to about 1500.

10. The composition of claim 7 wherein the reaction conditions comprise a temperature ranging from about 20° C. to about 50° C.

11. The composition of claim 7 wherein the polyalkylene polyamine is polyisobutylene-N,N-dimethyl 1,3-propanediamine.

12. The composition of claim 7 herein the reaction product is present in the range of from about 50 ppmw to about 500 ppmw based on the fuel composition.

13. The composition of claim 12 wherein the reaction product is present in the range of from about 100 ppmw to about 400 ppmw based on the fuel composition.

14. The composition of claim 7 wherein the mole ratio of furan to polyalkylene polyamine ranges from about 1:1 to about 3:1.

15. A method for operating an electronic port fuel injected engine on an unleaded fuel composition compatible with carburetor and throttle body injected engines which comprises introducing into an electronic port fuel injected engine with the combustion intake charge an effective amount to reduce intake valve deposits of a composition comprising the reaction product of (a) an oil soluble polyalkylene polyamine containing at least one polyalkylene polymer chain having at least one double bond and which chain is attached to a nitrogen and/or carbon atom of the alkylene radical(s) connecting the amino nitrogen atoms with said polyalkylene polyamine having a molecular weight in the range of from about 600 to about 10,000 and (b) furan, wherein the mole ratio of furan to polyalkylene polyamine ranges from about 1:1 to about 10:1, said reaction product being obtained under Diels-Alder reaction conditions wherein the temperature ranges from about 0° C. to about 200° C.

16. The method of claim 15 wherein the polyamine has a molecular weight in the range of from about 600 to about 5000.

17. The method of claim 16 wherein the polyamine has a molecular weight in the range of from about 600 to about 1500.

18. The composition of claim 15 wherein the reaction conditions comprises a temperature ranging from about 20° C. to about 50° C.

19. The composition of claim 15 wherein the polyalkylene polyamine is polyisobutylene-N,N-dimethyl 1,3-propanediamine.

20. The method of claim 15 wherein the mole ratio of furan to polyalkylene polyamine ranges from about 1:1 to about 3:1. t

* * * * *